US008460058B2

(12) United States Patent
Yoshida et al.

(10) Patent No.: US 8,460,058 B2
(45) Date of Patent: Jun. 11, 2013

(54) COMPLEX APPARATUS AND METHOD FOR POLISHING AN INGOT BLOCK

(75) Inventors: Yutaka Yoshida, Gunma (JP); Kazuo Kobayashi, Gumma (JP); Tsuyoshi Toshida, Gunma (JP); Yukio Uehara, Gunma (JP); Yasuhiro Terakubo, Gunma (JP); Hirotsugu Saitou, Gunma (JP)

(73) Assignee: Okamoto Machine Tool Works, Ltd., Annaka (JP)

( * ) Notice: Subject to any disclaimer, the term of this patent is extended or adjusted under 35 U.S.C. 154(b) by 395 days.

(21) Appl. No.: 12/965,526

(22) Filed: Dec. 10, 2010

(65) Prior Publication Data

US 2011/0306277 A1 Dec. 15, 2011

(30) Foreign Application Priority Data

Jun. 9, 2010 (JP) ..... 2010-131606

(51) Int. Cl.
*B24B 1/00* (2006.01)

(52) U.S. Cl.
USPC ..... 451/11; 451/49; 451/57; 451/58; 451/65; 451/264

(58) Field of Classification Search
USPC ..... 451/11, 49, 57, 58, 65, 73, 262, 268, 451/264, 320
See application file for complete search history.

(56) References Cited

U.S. PATENT DOCUMENTS

| | | | | |
|---|---|---|---|---|
| 543,458 | A * | 7/1895 | Berry | 451/262 |
| 1,024,435 | A * | 4/1912 | Bissell | 451/65 |
| 1,644,057 | A * | 10/1927 | Heim | 451/268 |
| 1,902,022 | A * | 3/1933 | Gaisman | 451/65 |
| 2,106,442 | A * | 1/1938 | Stevens | 134/6 |
| 3,079,740 | A * | 3/1963 | Fallon | 451/1 |
| 4,497,138 | A * | 2/1985 | Schreiber | 451/65 |
| 4,524,547 | A * | 6/1985 | Heaston et al. | 451/5 |

(Continued)

FOREIGN PATENT DOCUMENTS

| | | |
|---|---|---|
| JP | 49-16400 | 4/1974 |
| JP | 4-322965 | 11/1992 |

(Continued)

OTHER PUBLICATIONS

JCM Co., Ltd., "Solar cell manufacturing device monocrystalline fully automatic production line," [online], Mar. 9, 2009 search, Internet <URL:http://www.e-jcm.co.jp/SolarCell/Mono/Auto/>.

*Primary Examiner* — George Nguyen
(74) *Attorney, Agent, or Firm* — Oblon, Spivak, McClelland, Maier & Neustadt, L.L.P.

(57) ABSTRACT

A compound chamfering device that manufactures prism-shaped ingot blocks of excellent surface smoothness is disclosed. The four-corner round surfaces and the four sides of a prism-shaped ingot obtained by using a pair of rotary blades of a slicer to perform four-side peeloff of a cylindrical ingot block are chamfered by rough grinding with a pair of cup wheel type rough grinding grindstones. A pair of cup wheel type finishing grinding grindstones are used to chamfering by finishing grinding the four-corner round surfaces and the four sides of the block.

9 Claims, 6 Drawing Sheets

U.S. PATENT DOCUMENTS

| | | | | |
|---|---|---|---|---|
| 4,584,794 | A * | 4/1986 | Hirohata | 451/160 |
| 4,586,296 | A * | 5/1986 | Saunders | 451/1 |
| 5,720,652 | A * | 2/1998 | Steinwender et al. | 451/254 |
| 5,921,848 | A * | 7/1999 | Zang et al. | 451/57 |
| 5,924,911 | A * | 7/1999 | Brålander | 451/5 |
| 5,934,983 | A * | 8/1999 | Wada et al. | 451/63 |
| 5,975,997 | A * | 11/1999 | Minami | 451/287 |
| 6,315,646 | B1 * | 11/2001 | Hoyashita | 451/65 |
| 6,322,426 | B1 * | 11/2001 | Akagi et al. | 451/49 |
| 7,150,674 | B2 * | 12/2006 | Okura | 451/8 |
| 7,347,765 | B2 * | 3/2008 | Koch | 451/9 |
| 8,221,194 | B2 * | 7/2012 | Himmelsbach et al. | 451/10 |
| 2003/0228832 | A1 * | 12/2003 | Nien | 451/319 |
| 2008/0223351 | A1 | 9/2008 | Morikawa et al. | |

FOREIGN PATENT DOCUMENTS

| | | |
|---|---|---|
| JP | 6-166600 | 6/1994 |
| JP | 6-246630 | 9/1994 |
| JP | 8-73297 | 3/1996 |
| JP | 2002-252188 | 9/2002 |
| JP | 2004-6997 | 1/2004 |
| JP | 4133935 | 12/2005 |
| JP | 2009-55039 | 3/2009 |
| JP | 2009-99734 | 5/2009 |
| JP | 2009-233794 | 10/2009 |
| JP | 2009-296602 | 12/2009 |
| JP | 2010-061844 | 3/2010 |

* cited by examiner

COMPLEX APPARATUS AND METHOD FOR POLISHING AN INGOT BLOCK

BACKGROUND OF THE INVENTION

1. Field of the Invention

The present invention concerns a compound chamfering device that can chamfer the side or circumferential surface of a prism-shaped polycrystalline silicon ingot block or monocrystalline silicon ingot block of a raw material of a square or rectangular substrate to be used as the substrate of a solar cell (solar light-emitting electric panel). It also concerns a method for using this compound chamfering device to manufacture a smooth-surface ingot silicon ingot block by chamfering the four corners or the four side surfaces of an ingot block whose C-axis end faces are cut off. When the manufactured smooth-surface ingot silicon ingot block is sliced with a wire-cut saw to a thickness of 200-240 μm to simultaneously obtain many solar-cell silicon substrates, chipping or cracking will not occur in the resulting silicon substrate.

2. Description of the Related Art

In the process of manufacturing a solar-cell silicon substrate, four circumferential pieces of the circular cross-section of a cylindrical monocrystalline silicon ingot are cut away with a band saw to make a prism-shaped silicon ingot (workpiece) leaving an arc (R corner part) on the four corners, then it is supported in a clamping device consisting of the head stock and tail stock of a horizontal cylindrical grinder. The surface of the four sides is chamfered to the desired thickness (8-10 mm) with a cup wheel type grindstone, then it is sliced to manufacture square-shaped silicon substrates 200-330 μm thick (for example, see non-patent reference 1).

Also used as prism-shaped silicon ingot blocks are ingot blocks that are made by cutting a polycrystalline silicon ingot into 2 to 4 blocks. The polycrystalline silicon ingot is obtained by injecting a liquid of molten metal silicon into a prism-shaped graphite container, solidifying it unidirectionally, then chamfering with a band saw the lower end face and side that are contact-contaminated with the inner surface of the container. Prism-shaped monocrystalline silicon ingot blocks for solar cells are made, when semiconductor substrate production is slack, by cutting off with a slicer the four sides of a cylindrical silicon ingot block for semiconductor substrate manufacturing so as leave partially a round part, then chamfering both end faces, then doing corner round chamfering on the cylindrical ingot block (margin 7.5-8 mm), then chamfering the four side planes (margin 0.5-1 mm). A monocrystalline silicon substrate has a greater photoconversion efficiency than a polycrystalline silicon substrate, but is more difficult to chamfer.

For example, unexamined patent H8-73297 [1996] (patent reference 1) proposes a polycrystalline silicon ingot manufacturing method in which molten metal silicon, obtained by reducing quartz or quartz sand in an electric furnace, is poured into a heat-resistant column-shaped container, and slowly cooling it from the lower end of the container to the upper end in order to make a unidirectionally solidified prism-shaped polycrystalline silicon ingot rod. The lower end face and side that are contact-contaminated with the inner surface of the container are chamfered by grinding and polishing with a margin of 5 mm, then etching is done with an aqueous solution of a mixture of hydrofluoric acid and nitric acid.

U.S. Pat. No. 6,679,759 (patent reference 2) proposes a method in which the rough surface on the sides of a silicon ingot block, whose C-axis end face is cut off perpendicularly, is polished with a polishing tool to give it a surface smoothness Ry of 8 μm or less. The silicon ingot block is then made into a solar-cell silicon substrate 200-330 μm thick. This patent reference states that with a silicon block whose surface smoothness Ry is 8 μm or less, no cracking or chipping will occur in the substrate even if the silicon ingot block is simultaneously cut with a wire saw into solar-cell silicon substrates 200-330 μm thick.

In addition, unexamined patent 2009-99734 (patent reference 3) proposes a silicon wafer manufacturing method in which a silicon ingot formed by casting is cut into multiple silicon blocks and then the silicon blocks are sliced into many silicon wafers. The silicon wafer manufacturing method includes a grinding process in which, when the silicon ingot formed by casting is cut into multiple (2-4) silicon blocks, at least one surface of the silicon ingot is first ground flat, and a silicon block cutout process in which the silicon ingot is placed on a base with its surface that has been ground flat facing downward, and multiple silicon blocks are cut out from the silicon ingot.

Unexamined patent 2004-6997 (patent reference 4) proposes a method for manufacturing angular wafers in which a cylindrical silicon block for manufacturing silicon wafers for solar cells is chamfered with a band saw and made into a prism-shaped silicon block. The side planes are polished with a roll-type diamond sponge flat grindstone, and the block is then sliced.

Unexamined patent 2009-55039 (patent reference 5) proposes a method for manufacturing angular wafers in which a cylindrical silicon block is chamfered with a band saw to make a prism-shaped silicon block, the side planes are roughly polished with a cup wheel type grindstone whose abrasive grain diameter is 60-80 μm, and the side planes are finish polished with a cup wheel type grindstone whose abrasive grain diameter is 3-40 μm. The surface is further etched, and the block is then sliced.

The specification of U.S. Pat. No. 4,133,935 (patent reference 6) proposes a method for manufacturing roughly square-shaped thin silicon substrates in which a silicon ingot formed by casting undergoes cylindrical polishing to make its outer circumferential surface smooth, its four sides are cut away with a slicer or other side-peeloff machine to make a silicon ingot of roughly square cross section having four corners rounded off. The ingot is cut off to make multiple silicon ingot blocks, and in addition the four sides are polished flat with a polishing tool, making the smoothness Ry of the side 10-20 μm, and this silicon ingot block is cut off perpendicularly with a wire cut method.

Unexamined patent 2009-233794 (patent reference 7) proposes a method in which, when grinding/polishing the surface of a silicon block, the front and back of the silicon block in the longitudinal direction are held with a pair of chucking members (the head stock and the tail stock) that do chucking (clamping) mechanically. In this state, the sides of the silicon block and the four angles (the round corner parts on the four corners) that join them are ground and polished using a rough grinding grindstone and a precision-finishing grindstone. Because this method can keep the four angles and four sides of the silicon block in a state in which the chucking members are made to float in the air without making contact, any injury to the sides and angles can be prevented. Because the angles as well as the sides of the silicon block can be chamfered by grinding and polishing when manufacturing silicon wafers by slicing the silicon block, any nicking of the circumferential edge can be avoided and the yield can be improved.

It has been pointed out by substrate processing manufacturers that as the length of the side of a prism-shaped silicon ingot gets longer, from 50 mm to 125 mm, 156 mm, 200 mm, then 240 mm, when mass-producing solar-cell silicon substrates 200-330 μm thick by all at once slicing with a wire cut saw a prism-shaped silicon ingot of side 156 mm to 240 mm, as stated above, chipping sometimes occurs in the round corner part of the prism-shaped silicon ingot, thereby raising the silicon substrate production loss rate. The occurrence of chipping during cutting of the wafers is prevented by the treatment method of doing wire saw cutting after flat-polishing the sides with a polishing tool as in patent reference 3 and patent reference 6 above, by the method of polishing with a polishing brush as described in unexamined patent 2002-252188 (patent reference 8), or by the method of etching treatment.

Currently, it takes about 95-120 minutes to chamfer a prism-shaped monocrystalline silicon ingot of side 156 mm and height 250 mm whose four corners are cut off leaving rounded-off corner parts, and it takes about 180-210 minutes to chamfer a prism-shaped monocrystalline silicon ingot of side 156 mm and height 500 mm whose four corners are cut off leaving rounded-off corner parts. To this processing time, 10 minutes of transfer time are added to move the silicon ingot from the rough grinder to the finishing grinder.

In other patents, examined patent S49-16400 [1974] (patent reference 9), unexamined patent H4-322965 [1992] (patent reference 10), unexamined patent H6-166600 [1994] (patent reference 11), and unexamined patent H6-246630 [1994] (patent reference 12) propose a horizontal cylindrical grinder that chamfers the surface of a cylindrical silicon ingot for manufacturing silicon substrates for semiconductor substrates.

The horizontal cylindrical grinder disclosed in patent references 9 to 12 consists of a clamping mechanism consisting of a pair made up of a head stock that causes the center axis to rotate by a servomotor via a speed reduction mechanism and a tail stock that can move in the left-right direction; a raising-and-lowering mechanism that raises and lowers a grinding head axially supported on the grindstone shaft so that the shaft center of the cylindrical silicon ingot faces in a horizontal (side) direction by means of the head stock center and the tail stock center of this clamping mechanism, and the circular plane of the disk-shaped flat grindstone faces the upper surface of the circumference of the cylindrical ingot, which is rotatably supported; and a movement mechanism that causes the grinding head to move in a straight line left and right parallel to the shaft center of the cylindrical ingot.

In the cylindrical grinding of the cylindrical silicon ingot, the bottom of the disk-shaped flat grindstone is lowered by the raising-and-lowering mechanism to a height position for chamfering at the height position of the circumferential top of the rotating cylindrical ingot. By the linear movement mechanism, the grinding head is moved rightward. While causing the disk-shaped flat grindstone of the grinding head to rotate on the circumferential top of the cylindrical ingot, it is brought into contact with the cylindrical ingot and cutting-in begins. After the disk-shaped flat grindstone reaches the right-end position of the cylindrical ingot, the disk-shaped flat grindstone is lowered by the raising-and-lowering mechanism by the height of the cutting-in amount. The direction of movement of the disk-shaped flat grindstone is reversed to leftward by the linear movement mechanism. After the disk-shaped flat grindstone reaches the left end position of the cylindrical ingot, the disk-shaped flat grindstone is lowered by the raising-and-lowering mechanism by the height of the cutting-in amount. The grinding head is moved rightward by the linear movement mechanism and the disk-shaped flat grindstone reaches the right-end position of the cylindrical ingot. The disk-shaped flat grindstone is lowered by the raising-and-lowering mechanism by the height of the cutting-in amount. The direction of movement of the disk-shaped flat grindstone is reversed to leftward by the linear movement mechanism. After the disk-shaped flat grindstone reaches the left-end position of the cylindrical ingot, likewise below there is repeated lowering, reversal, chamfering, lowering, reversal, chamfering of the disk-shaped flat grindstone, and chamfering is done to the desired thickness (10 μm to 5 mm).

The patent applicant of this application has proposed, in the specification of patent application 2009-296602 (patent reference 13), a compound chamfering device that will make it possible to quickly manufacture a prism-shaped silicon ingot block with no occurrence of chipping during wire cutting, in which a workpiece loader is attached to a chamfering device having a workpiece loading/unloading stage, a workpiece side rough grinding stage, a workpiece side finishing grinding stage, and a workpiece four-corner rounding-off finishing grinding stage.

The patent applicant of this application has also proposed, in the specification of patent application 2010-61844 (patent reference 14), an ingot block compound chamfering device 1 (see FIG. 5 and FIG. 6) that is characterized in that it has a) a workpiece table 4 provided so as to allow left-right back-and-forth movement on guide rails provided in the left-right direction on a machine frame 2, b) a clamping mechanism consisting of a pair made up of a head stock 7*a* and a tail stock 7*b* that are mounted separately on the left and right on this workpiece table, c) a drive mechanism 5 that causes left-right back-and-forth movement of the workpiece table 4 on which is mounted the clamping mechanism, which holds a workpiece (ingot block) w, being the direction in which one sees the workpiece table perpendicularly from the front side, and facing from the left-side direction to the right-side direction, d) an ingot block side-peeloff stage 90 on which are provided, in front of and in back of the workpiece table with the workpiece table in between, a pair of rotary blades (slicer blades) 91*a*, 91*b* axially supported on a pair of spindles 92*a*, 92*b* that can move forward and backward, so that their diameter planes face each other, e) a first grinding stage 11 in which a pair of cup wheel type grindstones 11*g*, 11*g* axially supported on a pair of grindstone shafts that can move forward and backward are provided in front of and behind the workpiece table with the workpiece table between them, in such a way that the grindstone planes face each other, f) a second grinding stage 10 that is provided parallel to the right horizontal side of the first grinding stage and in which a pair of cup wheel type grindstones 10*g*, 10*g* axially supported on a pair of grindstone shafts that can move forward and backward are provided in front of and behind the workpiece table with the workpiece table between them, in such a way that the grindstone planes face each other, g) a load port 8 that is on the right horizontal side of the second grinding stage and has, in the housing material positioned on the front side of the workpiece table, an opening through which the workpiece can be moved into and out of the clamping mechanism, and, h) on the rear side of the workpiece table that is opposite the load port 8, a round corner part finishing grinding stage 9 in which a grindstone shaft having a grindstone wheel is parallel to the left-right direction of the workpiece table, and this grindstone shaft is provided on a tool table in such a way that its shaft center can move forward and backward.

REFERENCES

Patent References

Patent reference 1: Unexamined patent H8-73297 [1996]

Patent reference 2: U.S. unexamined patent No. 2008/0223351A1 specification

Patent reference 3: Unexamined patent 2009-99734
Patent reference 4: Unexamined patent 2004-6997
Patent reference 5: Unexamined patent 2009-55039
Patent reference 6: U.S. Pat. No. 4,133,935 specification
Patent reference 7: Unexamined patent 2009-233794
Patent reference 8: Unexamined patent 2002-252188
Patent reference 9: Examined patent S49-16400 [1970]
Patent reference 10: Unexamined patent H4-322965 [1992]
Patent reference 11: Unexamined patent H6-166600 [1994]
Patent reference 12: Unexamined patent H6-246630 [1994]
Patent reference 13: Patent application 2009-299602 specification (unpublished)
Patent reference 14: Patent application 2010-61844 specification (unpublished)

Non-Patent References

[Non-patent reference 1] JCM Co., Ltd., "Solar cell manufacturing device monocrystalline fully automatic production line", [online], Mar. 9, 2009 search, Internet <URL: http://www.e-jcm.co.jp/SolarCell/Mono/Auto/>

SUMMARY OF THE INVENTION

Problem that the Invention is to Solve

With a throughput processing time of 40-45 minutes, the compound chamfering device described in patent reference 14 can chamfer a prism-shaped monocrystalline silicon ingot whose side is 156 mm, whose height is 250 mm, and which is cut with a band saw leaving a round part on the four corners, and it can process with high productivity an ingot block having an extreme degree of smoothness, in which the surface smoothness Ry is 0.2-0.5 μm. Also, because it has a side-peeloff processing stage 90 with a slicer, there is the advantage that during slack times in the production of semiconductor substrates, it can process left-over cylindrical silicon ingot blocks into prism-shaped silicon ingot blocks for solar cell substrates.

But it has been learned that cup wheel type grindstones must be replaced frequently, due to the friction of the outer circumferential edge of the grindstone blade of a cup wheel type grindstone in the chamfering of the four-corner round corner parts with a cup wheel type grindstone. And as described in patent reference 2, in order to prevent chipping and cracking when slicing an ingot block with a wire saw, the surface smoothness Ry of the ingot block should be no greater than 8 μm, and in rear-surface grinding of the silicon base of a semiconductor substrate with a cup wheel type grindstone, a silicon base whose surface smoothness Ry is 0.5-2 μm can be obtained. Thus, the inventors of the present invention have deduced that the footprint of the device can be made smaller by using a cup wheel type grindstone instead of the grindstone wheel that chamfers the four-corner round corner parts The inventors of the present invention have decided, in the compound chamfering device 1 described in the above patent reference 14, to have e) a rough grinding stage in which a pair of cup wheel type grindstones axially supported on a pair of grindstone shafts that can move forward and backward and can be raised and lowered are provided at the front and back of the workpiece table, with the workpiece table between them, in such a way that the grindstone planes face each other, and f) a finishing grinding stage in which a pair of cup wheel type grindstones axially supported on a pair of grindstone shafts that can move forward and backward and can be raised and lowered are provided at the front and back of the workpiece table, with the workpiece table between them, in such a way that the grindstone planes face each other. The rough grinding stage is used for chamfering of the four-corner round corner parts of the silicon ingot and for chamfering of the four sides. The finishing grinding stage is used for chamfering of the four-corner round corner parts of the silicon ingot and for chamfering of the four sides. The inventors of the present invention have deduced that by eliminating the round corner part finishing grinding stage with a grindstone wheel, the footprint of the compound chamfering device can be made smaller and the ingot chamfering processing time can be shortened.

With regard to extending the useful lifetime of a cup wheel type grindstone, they have deduced that by raising and lowering the grindstone shaft during chamfering of the four-corner round corner parts of a silicon ingot and doing this in a state in which the height between the grindstone shaft centers of a pair of cup wheel type grindstones is separated by 50-220 mm, the area of the grindstone blades of the cup wheel type grindstones that come into contact with the round corner parts of the ingot block can be increased, and that this can be achieved by reducing the amount of wear of the cutting blade each time chamfering of the four-corner round corner parts is done.

The first objective of the present invention is to provide a compound chamfering device that can do grinding of the four-corners to round corner parts of a prism-shaped ingot block and surface grinding of the four sides in less time than with the compound chamfering device of the above patent reference 14.

The second objective of the present invention is to take the workpiece chucking mechanism (head stock and tail stock) provided on the ingot block workpiece loading/unloading stage of the compound chamfering device described in the above patent reference 13 and use it for a chucking mechanism for a block side-peeloff processing stage, attach a slicer to the left end side of the compound chamfering device, and provide a compound chamfering device that can do side-peeloff processing of the four sides of a cylindrical block, four-side flattening processing of a prism-shaped block formed by this side-peeloff processing, and four-corner round grinding processing.

Means of Solving the Problem

Claim 1 of the present invention provides an ingot block compound chamfering device that includes a) a workpiece table provided so as to allow left-right back-and-forth movement on guide rails provided in the left-right direction on the machine frame (base), b) a clamping mechanism consisting of a pair made up of a head stock and a tail stock that are mounted separately on the left and right on this workpiece table, c) a drive mechanism that causes left-right back-and-forth movement of the workpiece table on which is placed the workpiece supported in the clamping mechanism, d) the direction in which one sees the workpiece table perpendicularly from the front side, and facing from the left-side direction to the right-side direction, e) a rough grinding stage in which a pair of cup wheel type grindstones axially supported on a pair of grindstone shafts that can move forward and backward and can be raised and lowered are provided in front of and behind the workpiece table, with the workpiece table between them, in such a way that the grindstone planes face each other, and the diameter of one of the cup wheel type grindstones is 5-20 mm shorter than the diameter of the other cup wheel type grindstone, f) a finishing grinding stage that is provided parallel to the right horizontal side of the rough grinding stage and in which a pair of cup wheel type grindstones axially supported on a pair of grindstone shafts that can move forward and backward and can be raised and lowered are provided in front of and behind the workpiece table, with the workpiece table between them, in such a way that the grindstone planes face each other, and g) a load port that is on the right horizontal side position of the finishing grinding stage and has an opening through which the workpiece can be moved into and out of a clamping mechanism consisting of a pair made up of the head stock and tail stock mounted separately on the left and right of the workpiece table.

Claim 2 of the present invention provides a prism-shaped ingot block compound chamfering method that makes use of the ingot block compound chamfering device described in claim 1, and with a prism-shaped ingot block supported on the head stock and tail stock of a clamping mechanism in the load port position going through the following processes, the four-corner round corner parts and the four side planes are chamfered by cup wheel type grindstones.

1) A prism-shaped ingot block is supported on the head stock and tail stock of a clamping mechanism in the load port position.

2) The workpiece table, on which the clamping mechanism is mounted, is moved to the left, and the movement of the workpiece table is stopped in a position where the right end of the prism-shaped ingot block (the workpiece) has gone beyond the left end of the rough grinding stage's cup wheel type rough grinding grindstone.

3) One of the pair of grindstone shafts of the rough grinding stage is raised, the other is lowered, and the height between the two grindstone shaft centers is set to 50-220 mm.

4) The pair of grindstone shafts of the rough grinding stage are moved forward, the forward movement is stopped when the distance between the cup wheel type rough grinding grindstones axially supported on these grindstone shafts reaches the margin position of the four-corner round corner parts of the prism-shaped ingot block, then these grindstone shafts are made to rotate.

5) By causing the workpiece spindle shaft of the head stock of the clamping mechanism to rotate, the prism-shaped ingot block is made to rotate in its shaft center direction (the C axis), then the workpiece table is moved to the right, the round corner parts of the prism-shaped ingot block are brought into contact with the grindstone blades of the rotating cup wheel type rough grinding grindstones, the grinding process is begun, the rightward movement of the workpiece table is continued, and when the left end of the prism-shaped ingot block that is supported in the clamping mechanism goes beyond the right end position of the pair of cup wheel type grindstones, the rough chamfering of the round corner parts is brought to an end, and the grindstone shafts that axially support the pair of cup wheel type rough grinding grindstones are retracted. Also, the rotation of the workpiece spindle shaft of the head stock of the clamping device that supports the prism-shaped ingot block whose round corner parts have undergone rough chamfering is stopped.

6) The workpiece table on which is mounted the clamping device that supports the prism-shaped ingot block whose round corner parts have undergone rough chamfering is moved to the left, and the movement of the workpiece table is stopped in a position where the right end of the prism-shaped ingot block has gone beyond the left end of the cup wheel type rough grinding grindstones of the rough grinding stage.

7) One of the pair of grindstone shafts of the rough grinding stage is lowered, the other is raised, and they are adjusted to a position where the grindstone shaft centers of the two are on the same straight line with the shaft center of the prism-shaped ingot block.

8) The pair of grindstone shafts of the rough grinding stage are moved forward, and when the cup wheel type rough grinding grindstones axially supported on these grindstone shafts reach the margin position of the two sides of the prism-shaped ingot block, the forward movement of the grindstone shafts is stopped, then, by causing these grindstone shafts to rotate, the cup wheel type rough grinding grindstones that are axially supported on the grindstone shafts are made to rotate.

9) The workpiece table on which the clamping mechanism is mounted is moved to the right, and while both sides of the prism-shaped ingot block are brought into contact with the grindstone blades of the rotating cup wheel type rough grinding grindstones and the rough grinding is begun, the rightward movement of the workpiece table is continued, and when the left end of the prism-shaped ingot block that is supported in the clamping mechanism goes beyond the right end position of the pair of cup wheel type rough grinding grindstones, the rough chamfering of the two sides is brought to an end, and the grindstone shafts that axially support the pair of cup wheel type rough grinding grindstones are retracted.

10) The workpiece table on which the clamping mechanism is mounted is moved to the left, and the movement of the workpiece table is stopped in a position where the right end of the prism-shaped ingot block goes beyond the left end of the cup wheel type rough grinding grindstones of the rough grinding stage.

11) The workpiece spindle of the head stock of the clamping mechanism is made to rotate 90 degrees, putting the side of the silicon block that has not yet undergone rough grinding in position opposite the plane of the cup wheel type rough grinding grindstones.

12) The pair of grindstone shafts are moved forward, and when the cup wheel type rough grinding grindstones that are axially supported on these grindstone shafts reach the margin position of the two sides of the prism-shaped ingot block, the forward movement of the grindstone shafts is stopped.

13) The workpiece table on which the clamping mechanism is mounted is moved to the right, and while both sides of the prism-shaped ingot block are brought into contact with the grindstone blades of the rotating cup wheel type rough grinding grindstones and the rough grinding is begun, the rightward movement of the workpiece table is continued, and when the left end of the prism-shaped ingot block that is supported in the clamping mechanism goes beyond the right end position of the pair of cup wheel type grindstones, the rough chamfering of the two sides is brought to an end, the grindstone shafts that axially support the pair of cup wheel type rough grinding grindstones are retracted, then the rotation of the grindstone shafts is stopped.

14) One of the pair of grindstone shafts of the finishing grinding stage is raised, the other is lowered, and the height between the two grindstone shaft centers is set to 50-220 mm.

15) The pair of grindstone shafts of the finishing grinding stage are moved forward, the forward movement is stopped when the distance between the cup wheel type finishing grinding grindstones axially supported on these grindstone shafts reaches the margin position of the four-corner round corner parts of the prism-shaped ingot block, then these grindstone shafts are made to rotate.

16) By causing the workpiece spindle shaft of the head stock of the clamping mechanism to rotate, the prism-shaped ingot block is made to rotate in its shaft center direction, then the workpiece table on which is mounted the clamping mechanism that supports the prism-shaped ingot block that has been roughly ground is moved to the right, the round corner parts of the prism-shaped ingot block are brought into contact with the grindstone blades of the rotating cup wheel type finishing grinding grindstones, the grinding process is begun, the rightward movement of the workpiece table is continued, and when the left end of the prism-shaped ingot block that is supported in the clamping mechanism goes beyond the right end position of the pair of cup wheel type finishing grindstones, the round corner part finishing chamfering is brought to an end, and the grindstone shafts that axially support the pair of cup wheel type finishing grinding grindstones are retracted. Also, the rotation of the workpiece spindle shaft of the head stock of the clamping device that supports the prism-shaped ingot block that has undergone round corner part finishing chamfering is stopped.

17) The workpiece table on which is mounted the clamping device that supports the prism-shaped ingot block that has undergone round corner part finishing chamfering is moved to the left, and the movement of the workpiece table is stopped in a position where the right end of the prism-shaped ingot block has gone beyond the left end of the cup wheel type finishing grinding grindstones of the finishing grinding stage.

18) One of the pair of grindstone shafts of the finishing grinding stage is lowered, the other is raised, and they are adjusted to a position where the grindstone shaft centers of the two are on the same straight line with the shaft center of the prism-shaped ingot block.

19) The pair of grindstone shafts of the finishing grinding stage are moved forward, and when the cup wheel type finishing grinding grindstones axially supported on these grindstone shafts reach the margin position of the two sides of the prism-shaped ingot block, the forward movement of the grindstone shafts is stopped, then, by causing these grindstone shafts to rotate, the cup wheel type finishing grinding grindstones that are axially supported on the grindstone shafts are made to rotate.

20) The workpiece table on which the clamping mechanism is mounted is moved to the right, and while both sides of the prism-shaped ingot block are brought into contact with the grindstone blades of the rotating cup wheel type grindstones and the finishing grinding is begun, the rightward movement of the workpiece table is continued, and when the left end of the prism-shaped ingot block that is supported in the clamping mechanism goes beyond the right end position of the pair of cup wheel type finishing grinding grindstones, the finishing chamfering of the two sides is brought to an end, and the grindstone shafts that axially support the pair of cup wheel type finishing grinding grindstones are retracted.

21) The workpiece table on which the clamping mechanism is mounted is moved to the left, and the movement of the workpiece table is stopped in a position where the right end of the prism-shaped ingot block goes beyond the left end of the cup wheel type finishing grinding grindstones of the finishing grinding stage.

22) The workpiece spindle of the head stock of the clamping mechanism is made to rotate 90 degrees, putting the side of the silicon block that has not yet undergone finishing grinding in position opposite the plane of the cup wheel type finishing grinding grindstones.

23) The pair of grindstone shafts are moved forward, and when the cup wheel type finishing grinding grindstones that are axially supported on these grindstone shafts reach the margin position of the two sides of the prism-shaped ingot block, the forward movement of the grindstone shafts is stopped.

24) The workpiece table on which the clamping mechanism is mounted is moved to the right, and while both sides of the prism-shaped ingot block are brought into contact with the grindstone blades of the rotating cup wheel type finishing grinding grindstones and the finishing grinding is begun, the rightward movement of the workpiece table is continued, and when the left end of the prism-shaped ingot block that is supported in the clamping mechanism goes beyond the right end position of the pair of cup wheel type finishing grinding grindstones, the finishing chamfering of the two sides is brought to an end, the grindstone shafts that axially support the pair of cup wheel type finishing grinding grindstones are retracted, then the rotation of the grindstone shafts is stopped.

25) The workpiece table on which the clamping mechanism is mounted is moved to the right, the movement is stopped in the load port position, then the tail stock of the clamping mechanism is retracted, the support of the prism-shaped ingot block on which chamfering of the four-corner corner parts and chamfering of the four sides has ended is released, and this prism-shaped ingot block is transported to the outside of the compound chamfering device.

The ingot block compound chamfering device described in claim 3 of the present invention lies in an ingot block compound chamfering device that is characterized in that it has left-right movement guide rails for the workpiece table that extend to the left end face of the ingot block compound chamfering device described in claim 1, and has a side-peeloff stage in which the head stock and tail stock of the clamping mechanism on which the workpiece table is mounted have a workpiece holding shaft between them, and a pair of rotary blades are provided in front of and behind the workpiece table with the workpiece table between them, in such a way that their rotary blade diameter planes face each other.

Effects of the Invention

The ingot block compound chamfering device of the invention of claim 1 can eliminate the ingot block four-corner round corner part grinding stage with a grindstone wheel, and can therefore be made with a smaller footprint (installation area) than the compound chamfering device described in patent reference 14. Also, by adopting the chamfering method described in claim 2, the useful lifetime of a cup wheel type grinding grindstone can be extended 1.5- to 2-fold. In addition, it can chamfer a prism-shaped silicon ingot block of side 156 mm and height 250 mm in 27-38 minutes, which is a shorter time than the 40-45 minutes for the compound chamfering device described in patent reference 14. Also, for its throughput processing time for chamfering a prism-shaped silicon ingot of side 156 mm and height 500 mm, this can be done in 78-82 minutes. Moreover, the surface smoothness Ry of the four side faces of a chamfered ingot block is 0.5-2 μm, which is a considerably better value than the 5 μm given in the working example described in patent reference 3.

What can be done with the compound chamfering device described in claim 3 is that, with a cylindrical ingot block whose C-axis end face has been cut off being held in a clamping mechanism, four-side peeloff processing is done by rotation of the blades of a slicer, then, using a pair of rough grinding grindstones, the ingot block undergoes four-corner round rough grinding and four-side rough grinding, then, using a pair of finishing grinding grindstones, the ingot block undergoes four-corner round finishing grinding and four-side finishing grinding.

DETAILED DESCRIPTION OF THE PREFERRED EMBODIMENTS

Features of the compound chamfering device 1 described in claim 1 and claim 3 of the present invention are those of the compound chamfering device described in the specification of patent application 2010-61844: e) a first grinding stage 11 in which a pair 11*g*, 11*g* of cup wheel type grindstones axially supported on grindstone shafts that can move forward and backward are provided in front of and behind the workpiece table with the workpiece table between them, in such a way that the grindstone planes face each other, and f) in a second grinding stage 10 in which a pair 10*g*, 10*g* of cup wheel type grinding stones axially supported on a pair of grindstone shafts that can move forward and backward is provided in front of and behind the workpiece table with the workpiece between them, in such a way that their grindstone planes face each other, and the two grindstone shafts can move forward and backward and can be raised and lowered. Another feature is that it eliminates the finishing chamfering stage 9 for the four-corner round corner parts of a prism-shaped ingot block with a grindstone wheel.

Figure 1:
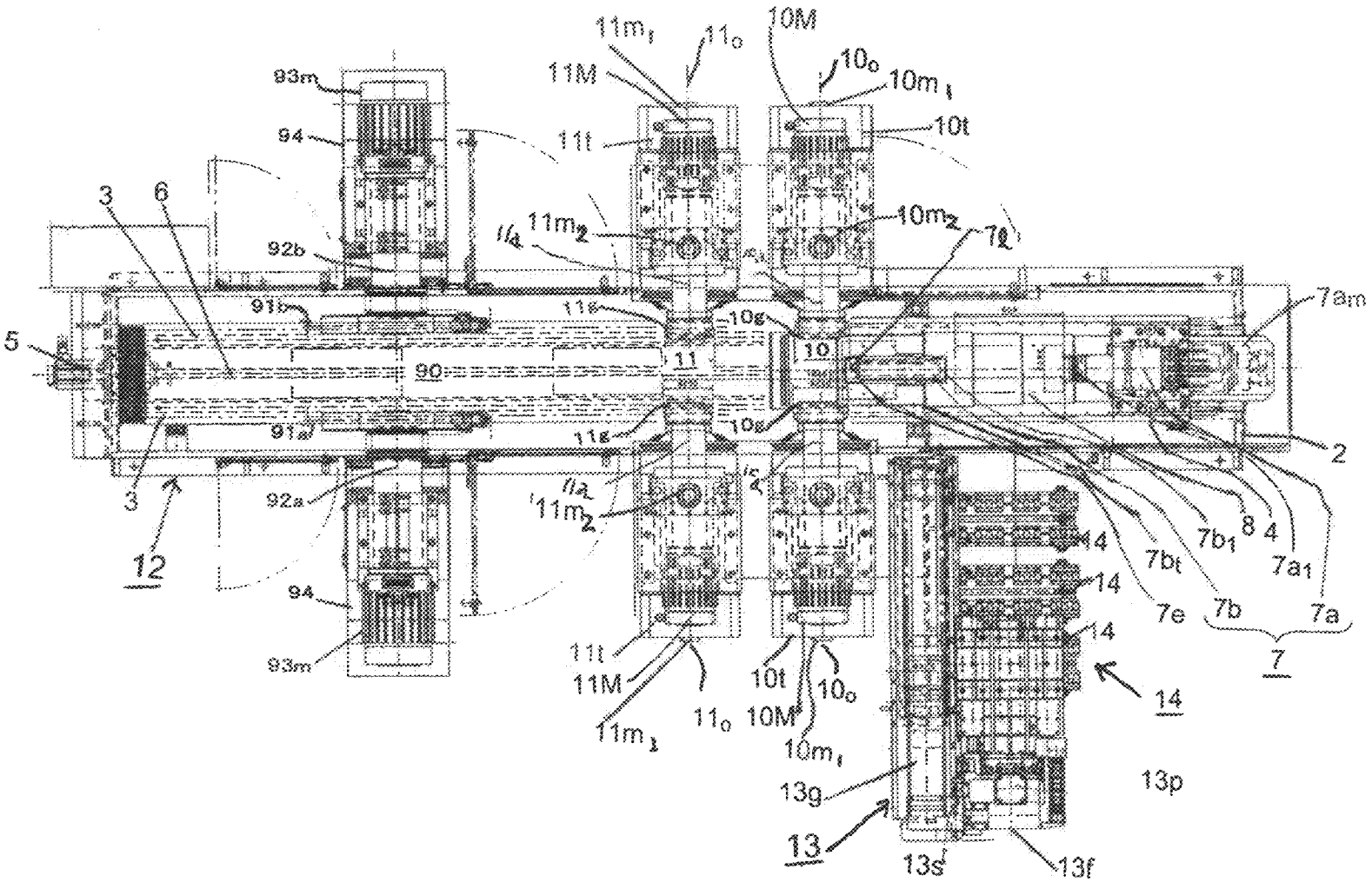
FIG. 1 is a plan view of a compound chamfering device having a side peeloff processing stage.
Figure 2:
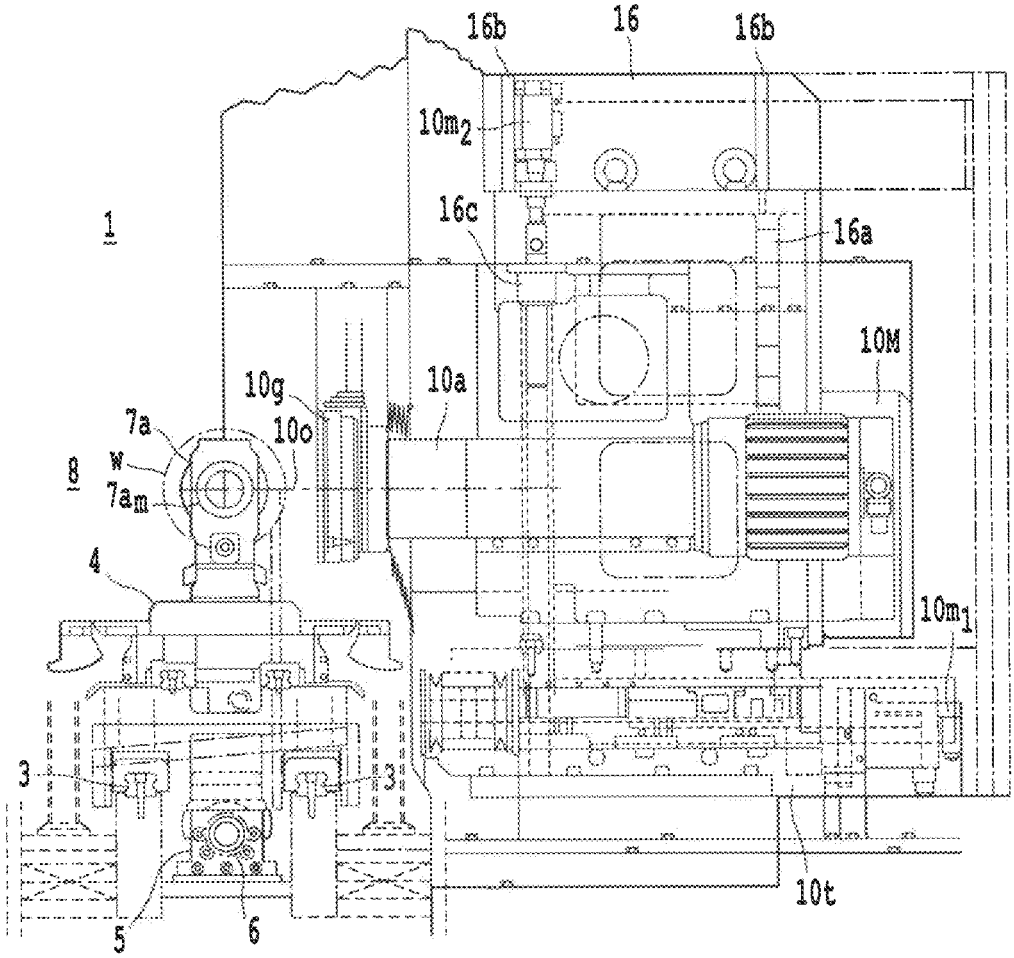
FIG. 2 is a partly cut-away left side view showing the center portion and rear portion of a compound chamfering device having a side peeloff processing stage.
Figure 3:
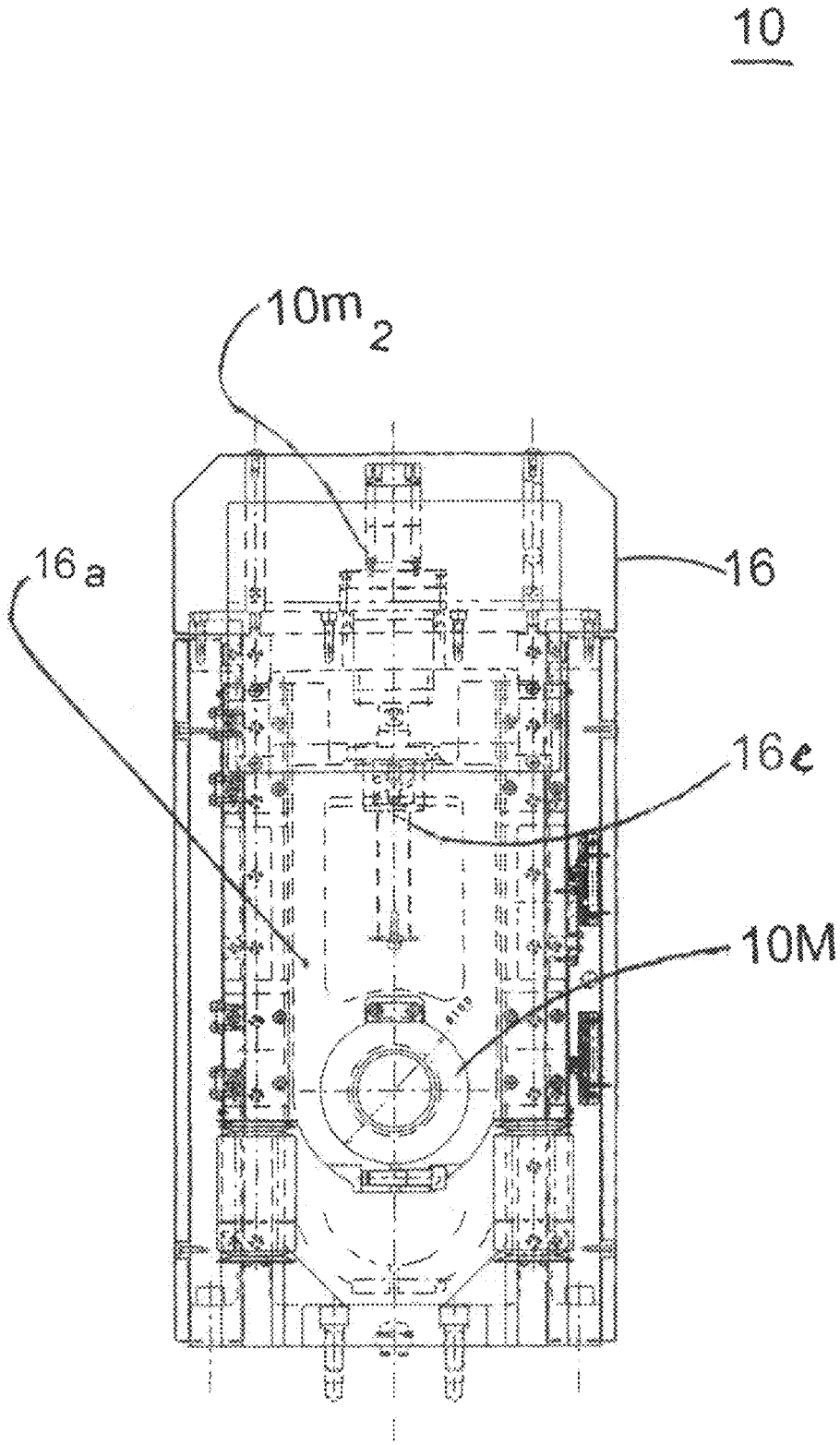
FIG. 3 is a partly cut-away rear side view of the finishing grinding stage of a compound chamfering device.

As shown in FIG. 1, FIG. 2, and FIG. 3, in the compound chamfering device 1, a workpiece table 4 is provided allowing back-and-forth movement in the left-right direction along a pair of guide rails 3, 3 extending in the left-right direction on the machine frame (base) 2. In the left-right back-and-forth movement of this workpiece table 4, a ball screw 6 receives the rotary motion created by a servomotor 5 and turns. Because a fixed platform 6*a* screwed to this ball screw 6 moves left or right, the workpiece table 4, in which the rear side of the workpiece table 4 is affixed to the surface of this fixed platform, advances left or right. Whether the workpiece table 4 advances left or right depends on whether the rotation axis of the servomotor 5 turns clockwise or counterclockwise.

Mounted on this workpiece table 4 is a clamping mechanism 7, which includes a pair made up of a head stock 7*a* and a tail stock 7*b*, which are mounted separately on the left and right. Thus, along with the movement of the workpiece table 4 left or right, this clamping mechanism 7 also moves left or right, and a workpiece (silicon ingot block) w, hanging in the air supported by the head stock center support shaft (workpiece spindle shaft) $7a_1$ and the tail stock center support shaft $7b_1$ of the clamping mechanism 7, can be moved into position at the side-peeloff stage 90, the finishing grinding stage 10, the rough grinding stage 11, or the load port 8.

The clamping mechanism 7 is a chucking mechanism that is well known, as referred to in patent reference 7; it is often used in cylindrical grinders. The head stock 7*a* has the function of rotating the workpiece w 360 degrees or 90 degrees by rotating the head stock center support shaft 7*a*1 with a servomotor $7a_m$. The tail stock 7*b* is provided on a moving platform $7b_t$ that can move left or right along the guide rails by the drive of an air cylinder 7*e*. Once the workpiece is supported by the clamping mechanism 7, it can be secured in place by pressing down the lever 7*l*, preventing movement, by movement of the workpiece table 4, of the moving platform $7b_1$ on which the tail stock 7*b* is mounted.

The relative positions of the side-peeloff stage 90, the finishing grinding stage 10, the rough grinding stage 11, and the load port 8 are such that when viewed perpendicularly from the front side of the workpiece table 4 and from the left-side direction to the right-side direction, the sequence is side-peeloff stage 90, rough grinding stage 11, finishing grinding stage 10, and load port 8. The side-peeloff stage 90, rough grinding stage 11, and finishing grinding stage 10 are covered by an airtight cover 12. Also, the load port 8 is closed by a one-sided horizontal sliding door. An exhaust duct (not pictured) communicates with the air in the grinding stages 10 and 11 and the side-peeloff stage 90, which are covered with the airtight cover 12, and any mist or grinding dust floating in this air is exhausted to the outside.

The finishing grinding stage 10 has a structure whereby a pair 10*g*, 10*g* of cup wheel type finishing grinding grindstones axially supported on a pair 10*a*, 10*a* of grindstone shafts provided on tool tables 10*t*, 10*t* that can move forward and backward by the rotation drive of servomotors $10m_1$, $10m_1$ are provided symmetrically in front of and behind the workpiece table 4, with the workpiece table 4 in between them, so that their grinding grindstone planes 10*gs*, 10*gs* face each other, and are provided positioned so that the grindstone shaft centers 10*o*, 10*o* are on the same straight line, and these grindstone shafts 10*a*, 10*a* are turned by the rotation drive of servomotors 10M, 10M. These grindstone shafts 10*a*, 10*a* are secured to an anchoring plate 16*a*, and this anchoring plate 16*a* is such that by the ball screw 16*c* being turned by the rotation drive of servomotors $10m_2$, $10m_2$. The anchoring plate 16*a* can move up or down along guide rails 16*b*, 16*b* provided on the front of the column 16. Because the grindstone shafts 10*a*, 10*a* can be raised or lowered, during grinding of the ingot block the grindstone shaft center height of the pair of cup wheel type finishing grinding grindstones 10*g*, 10*g* can be set to the same height for both, or they can also be positioned to different heights.

Also, the ball screw turns subject to rotation drive by the servomotors $10m_1$, $10m_1$. By advancing or retracting forward or backward the fixed platform, that is screw-joined by this ball screw, and the tool tables 10*t*, 10*t*, in which the back of the tool tables 10*t*, 10*t* is affixed to the surface of this fixed platform, move to advance or retract. The direction of movement of these tool tables, either advancement or retraction, depends on whether the rotation shaft of the servomotors $10m_1$, $10m_1$ turns clockwise or counterclockwise.

The rough grinding stage 11 has a structure whereby a pair 11*g*, 11*g* of cup wheel type rough grinding grindstones, axially supported on a pair 11*a*, 11*a* of grindstone shafts provided on tool tables 11*t*, 11*t* that can move forward and backward by the rotation drive of servomotors $11m_1$, $11m_1$, are provided symmetrically in front of and behind the workpiece table 4, with the workpiece table 4 in between them, so that their grinding grindstone planes 10*gs*, 10*gs* face each other, and positioned with the grindstone shaft centers 11*o*, 11*o* on the same straight line, and these grindstone shafts 11*a*, 11*a* are turned by the rotation drive of servomotors 11M, 11M. These grindstone shafts 11*a*, 11*a* are secured to an anchoring plate, and this anchoring plate is such that it is turned by the rotation drive of servomotors 11$m_2$, 11$m_2$ and can move up or down along the guide rails provided in front of the column.

The ball screw turns by the rotation drive by the servomotors 11$m_1$, 11$m_1$. By the advancement or retraction forward or backward of the fixed platform that is screw-joined by this ball screw, the tool tables 11*t*, 11*t*, to which the back of the tool tables 11*t*, 11*t* is affixed to the surface of this fixed platform, advance or retract. The direction of movement of these tool tables, either advancement or retraction, depends on whether the rotation shaft of The servomotors 11*m*1, 11*m*1 turns clockwise or counterclockwise.

The rough grinding stage 11 is provided in such a way that the grindstone shafts are parallel to the right horizontal side of the finishing grinding stage 10. That is, it is provided in such a way that the grindstone shaft centers 10*o*, 11*o* of the two grinding stages 10, 11 are parallel.

The grinding number of a cup wheel type grindstone used in the rough grinding stage 11 should be 130-200, and the grinding number of a cup wheel type grindstone used in the finishing grinding stage 10 should be 380-700.

To prevent grinding burning of the silicon ingot when the purpose is a square-shaped solar-cell silicon substrate of side 150 mm, the cup grindstone diameter or ring grindstone diameter of the cup wheel type grinding grindstones 10*g*, 10*g* and 11*g*, 11*g* should be 230-260 mm, the width of the cup grindstone pieces 10*gs*, 11*gs* should be 3-10 mm, and the width of the ring-shaped grindstone should be 5-15 mm. The distance (radius) of the grindstone piece width outer circumference from the center of the grindstone is the same radius for the one cup wheel type rough grinding grindstone 11*g* and the two cup wheel type finishing grinding grindstones 10*g*, but for the cup grindstone diameter of the pair of cup wheel type rough grinding grindstones 11*g*, 11*g*, the diameter of one is 5-20 mm shorter than the diameter of the other, but this is desirable because it prevents yawing (vibration deflection of the front and rear sides) of the ingot block during four-corner round corner part rough grinding.

The abrasive grains of the grinding grindstones 10*g*, 11*g* should be diamond abrasive grains or CBN abrasive grains, and the binding agent (bond) should be metal bond, vitrified bond, or epoxy resin bond. For example, it is desirable that the cup wheel type grinding grindstones 10*g*, 11*g* be cup wheel type grindstones in which many grindstone blades are arranged annularly in rings in the lower part of a cylindrical cup-shaped grindstone metal holder with gap spacing by which the grinding fluid is dissipated, as disclosed in, for example, unexamined patent H9-38866 [1997], unexamined patent 2000-94342, unexamined patent 2004-167617, etc., and have a structure in which the grinding fluid supplied to the inner side of the metal holder is dissipated from the gaps. The diameter of the annular grindstone blades of this cup wheel type grindstone 11*g* should be a diameter that is 1.2 to 1.5 times the length of the side of the prism-shaped silicon ingot.

Used for the grinding fluid are pure water, colloidal silica water dispersion liquid, ceria water dispersion liquid, SC-1 liquid, SC-2 liquid, or pure water and these water dispersion liquids or grinding fluids used together. Also, as the grinding fluid, it is desirable to use only pure water from the aspect of water treatment for sake of the environment.

The load port is formed by having an opening 8 in the housing material that is located at the right horizontal side of the finishing grinding stage 10 and in front of the workpiece table 4, through which the workpiece can be moved into or out of the clamping mechanism 7.

As shown in FIG. 1, as it is anticipated that the workpiece will be a cylindrical silicon ingot block, guide rails 3, 3 for left-right movement of the workpiece table are provided extending to the left end of the compound chamfering device 1. A cylindrical ingot block side-peeloff stage 90 is also provided on which are provided, in front of and behind the workpiece table with the workpiece table between them, a pair 91*a*, 91*b* of rotary blades (slicer blades) axially supported by a pair of spindle shafts 92*a*, 92*b* that can move forward and backward, having between them the workpiece support shafts 7*a*1, 7*b*1 of the head stock 7*a* and tail stock 7*b* of the clamping mechanism on which the workpiece table 4 is mounted.

Forward and backward movement of the rotary blades 91*a*, 91*b* is done by rotary-driving a motor drive ball screw, not pictured, to move tool tables 94, 94 on which are mounted servomotors 93*m*, 93*m* that rotate the spindle shafts 92*a*, 92*b* that axially support the rotary blades 91*a*, 91*b*. The direction of motion in which this tool table 94 advances or retracts depends on whether the rotation shaft of the motor turns clockwise, or counterclockwise.

The pair of rotary blades 91*a*, 91*b* are axially supported on the pair of spindle shafts 92*a*, 92*b*. By these spindle shafts being rotated by the drive motors 93*m*, 93*m*, the rotary blades 91*a*, 91*b* are rotated at a rotation speed of 50-7,500 min-1 in the same clockwise direction with respect to the workpiece (the direction of rotation of the two spindle shafts are opposite each other). By moving the tool tables 94, 94 forward or backward, the spindle shafts 92*a*, 92*b* can be moved to the position where side peeloff of the ingot block w begins. The workpiece table 4 can move at a speed of 5-200 mm/min, and the rotation shafts 92*a*, 92*b* can be raised or lowered by up to 100 mm. Used for the rotary blades are diamond cutters in which a steel sheet of diameter 450-800 mm and thickness 0.1-1.0 mm is electrocoated with diamond fine particles.

By causing the workpiece table 4, on which is mounted the clamping mechanism 7 that horizontally supports the C axis of the workpiece (cylindrical ingot block), to move to the left, the front and back of the workpiece end faces come into contact with the pair of rotary blades 91*a*, 91*b*, and side peeloff is done in which the front side and back side of the cylindrical workpiece is sliced off in arc shape by these rotary blades. When the side peeloff of the front and back sides of the workpiece is completed, the support shaft of the head stock 7*a* of the clamping mechanism 7 is rotated 90 degrees to bring to the front and back positions the arc faces of the workpiece that have not yet been subjected to side peeloff. The workpiece table 4 is turned around rightward, the pair of rotary blades 91*a*, 91*b* are made to rotate in the reverse direction by the drive motors 93*m*, 93*m*, and side peeloff is done. The processing time for side peeloff of the four sides is 10-20 minutes for a cylindrical monocrystalline silicon ingot block of diameter 200 mm and height 250 mm, and is 18-36 minutes for a cylindrical monocrystalline silicon ingot block of diameter 200 mm and height 500 mm.

As shown in FIG. 1, the ingot block compound chamfering device 1 of the present invention is in front of the workpiece table 4, and a workpiece loading/unloading device 13 and workpiece stockers 14, 14, 14 holding three ingot blocks are arranged in a row on the machine frame 2 in the space between the load port 8 and the second grinding stage 10.

The workpiece stockers 14, 14, 14 have a V-shaped shelf tier of inverted isosceles triangle cross-section that can accommodate three ingot blocks (workpieces) tilted at 45 degrees, and they are on positioning pins that protrude from the machine frame 2.

The workpiece loading/unloading device 13 grips, with a pair of claws, one ingot block stored in a work stocker 14 V-shaped shelf tier. The workpiece is hung up by raising the two claws and is positioned in front of the load port 8 by retracting, moving to the right, and lowering. By further retracting it, the workpiece is conveyed from this load port 8 to between the head stock 7*a* and the tail stock 7*b* of the clamping device 7. After one end of the workpiece is brought into contact with the center support shaft $7a_1$ of the head stock 7*a*, the tail stock 7*b* is moved to the left with an air cylinder 7*e*. The other end is brought into contact with the center support shaft $7b_1$, and the workpiece is held V-tilted by 45 degrees with the four faces suspended in the air. Next, the claws are separated to release their hold on the workpiece. The fixed platform that supports the two claws is raised, is moved to the left, and is retracted in the forward direction, returning the claws to their standby position.

Also, the workpiece, which has been chamfered, washed, and blown dry while held in the clamping device 7 with its four faces suspended in the air, is held with the claws. The fixed platform that supports the claws is raised, is moved to the left, and is retracted in the forward direction. After the claws are moved above an empty shelf of the workpiece stockers 14, 14, 14, they are lowered. The workpiece is brought to the empty shelf, the claws are opened up, and the workpiece is released, after which the claws are returned to their standby position.

WORKING EXAMPLES

Using the ingot block compound chamfering device 1 of the present invention, as a workpiece w a cylindrical ingot block whose both ends are cut off in a plane is given side-peeloff and chamfering processing, making it into a prism-shaped silicon ingot block with arcs of length 5-30 mm left on the four corners.

1) Using the workpiece loading/unloading device 13, one ingot block (workpiece) stored in a workpiece stocker 14 V-shaped shelf tier is conveyed to the clamping mechanism that is in the position of the load port 8, then the workpiece is supported by the head stock 7*a* and tail stock 7*b* of the clamping mechanism 7.

Figure 4:
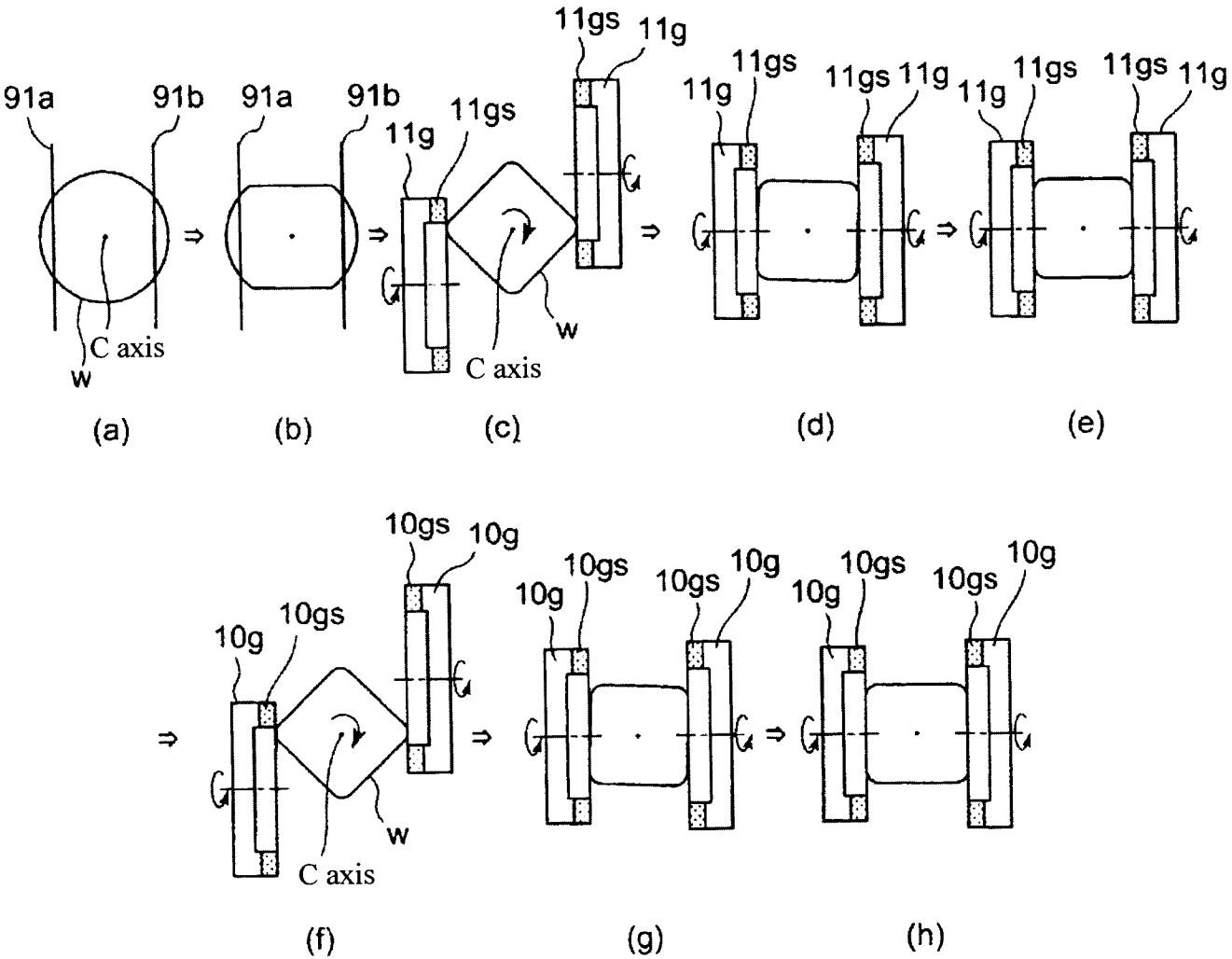
FIGS. 4 *a, b, c, d, e, f, g, h* is a flow diagram seen from the side of a compound chamfering device showing the process of chamfering a cylindrical ingot block into a prism-shaped ingot block.
Figure 5:
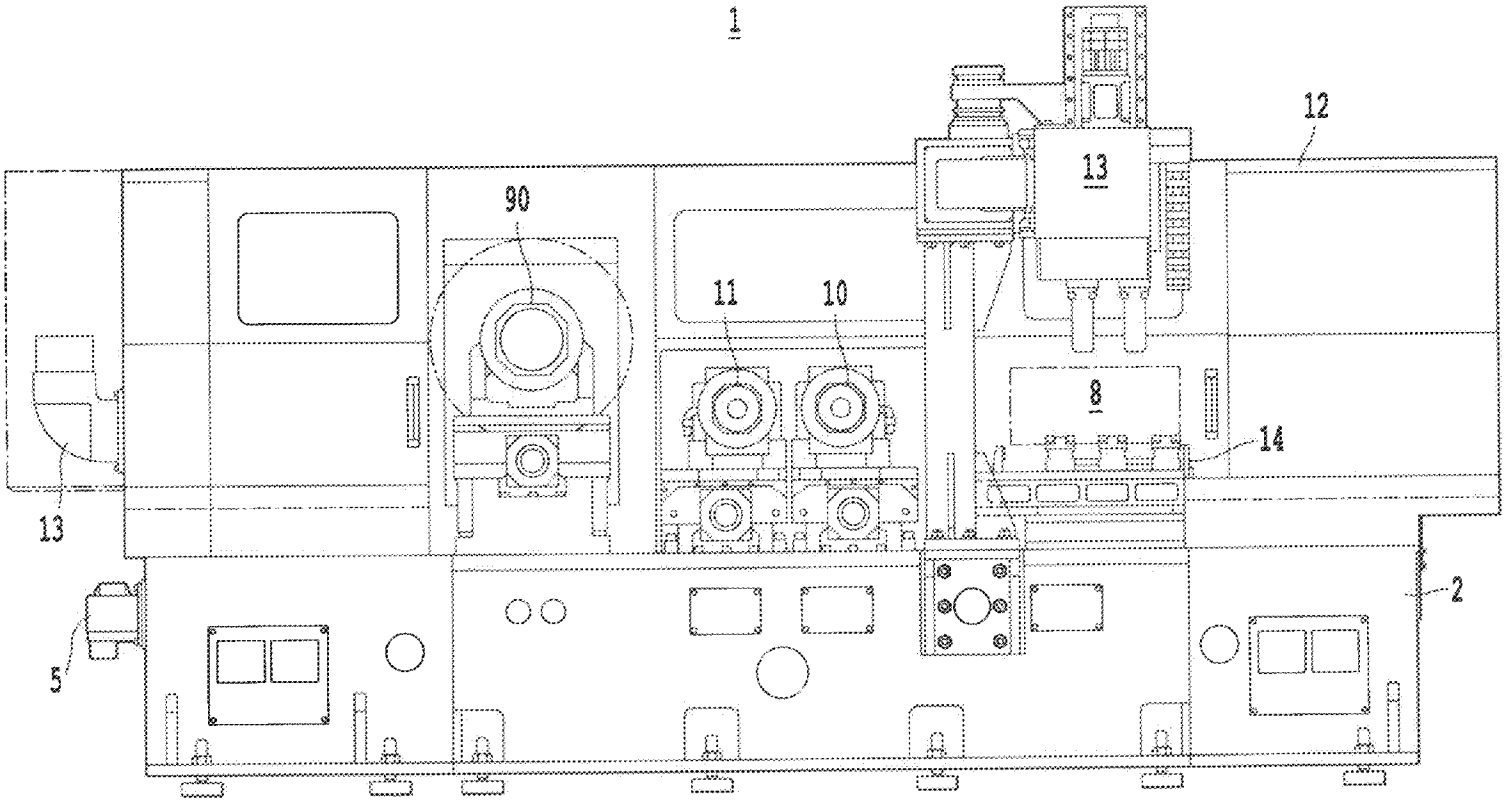
FIG. 5 is a front view of the compound chamfering device described in the specification of patent application 2010-61844 (unpublished).
Figure 6:
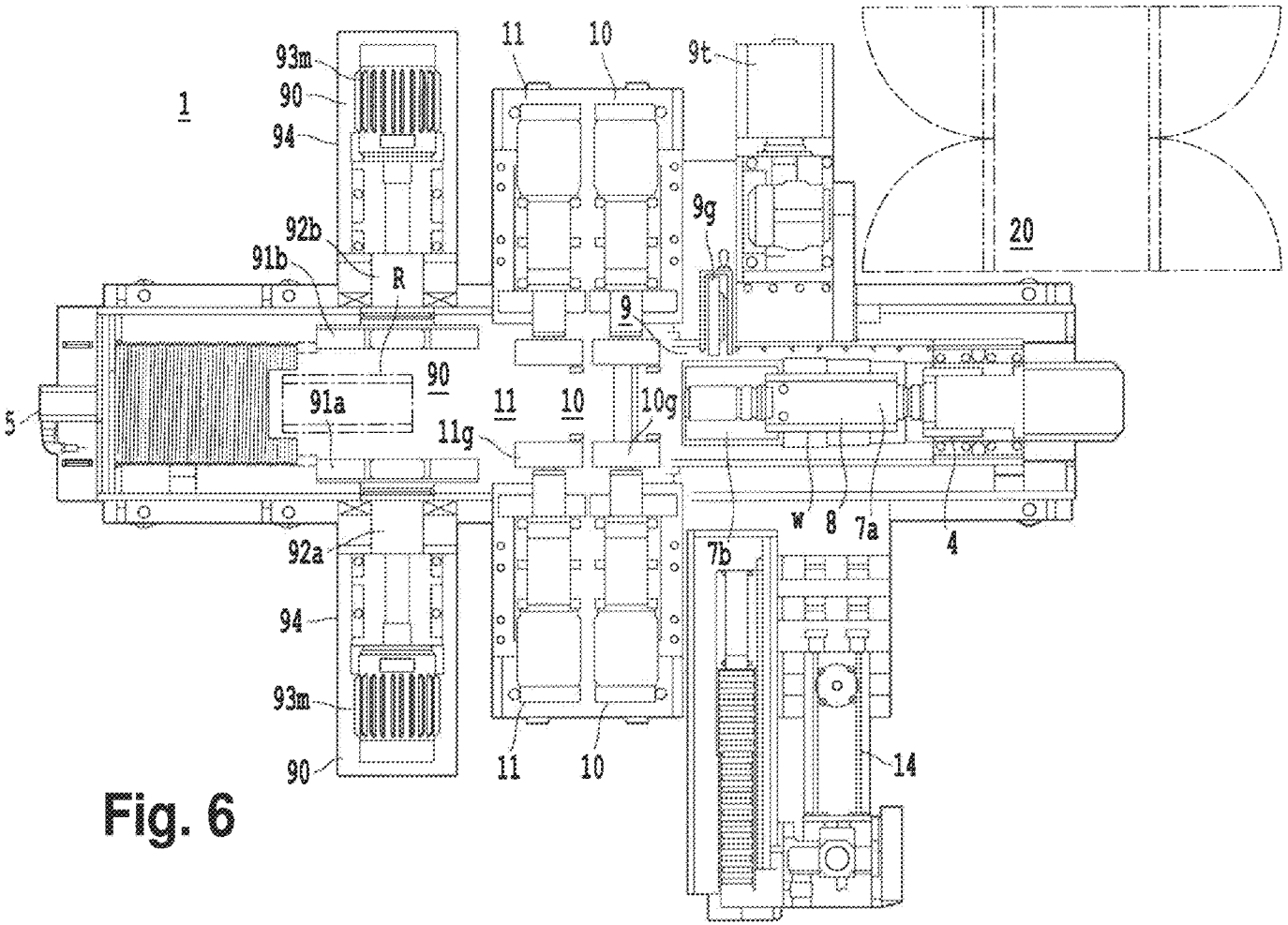
FIG. 6 is an oblique view of the compound chamfering device described in the specification of patent application 2010-61844 (unpublished).

2) The workpiece table 4, on which is mounted the clamping mechanism 7 that supports the ingot block suspended in the air, is moved to the left at a speed of 1-15 mm/min. The front and back end faces of the workpiece are brought into contact with a pair of rotary blades 91*a*, 91*b*, and with these rotary blades, side-peeloff processing is done, in which the front face and back face of a cylindrical workpiece are sliced off in an arc-shaped half moon (see FIG. 4*a*)

3) When the slicing-off of the front and back faces of the workpiece has been completed, the support shaft 7*a*1 of the head stock 7*a* of the clamping mechanism 7 is rotated 90 degrees. The arc faces of the workpiece, on which side-peeloff processing have not yet been done, are oriented in the front and back positions. The workpiece table 4 is reversed in the right direction, the pair of rotary blades 91*a*, 91*b* are rotated in the reverse direction with the drive motors 93*m*, 93*m*, and side-peeloff processing is done. For example, with a cylindrical ingot block of diameter 200 mm, the arc parts are sliced off so as to create a square cross section of side length approximately 155 mm (see FIG. 4*b*).

4) The workpiece table 4 on which the clamping mechanism is mounted is moved to the right. When the right end of the prism-shaped ingot block reaches a position near the left end of the cup wheel type rough grinding grindstone of the rough grinding stage, the rightward movement of the workpiece table 4 is stopped.

5) The front side 11 of the pair of grindstone shafts 11*a*, 11*a* of rough grinding stage 11 is lowered 5-110 mm, the back side 11*a* is raised 5-110 mm, and the height between the grindstone shaft centers 11*o*, 11*o* of the two is set to 50-220 mm.

6) The pair of grindstone shafts 11*a*, 11*a* on the rough grinding stage 11 are moved forward (feed speed 50-70 mm/min). When the distance between the cup wheel type rough grinding grindstones 11*g*, 11*g* that are axially supported on these grindstone shafts reaches the margin position of the four corners R corner parts of the prism-shaped ingot block, the advancing movement of the grindstone shafts is stopped. The grindstone shafts 11*a*, 11*a* are then turned at 1,800-2,500 rpm.

7) By rotating the workpiece spindle shaft $7a_1$ of the head stock 7*a* of the clamping mechanism by 45 degrees, the prism-shaped ingot block is rotated in its shaft-center direction (C axis). While the workpiece table 4 is moved to the right (the feed speed is 40-70 mm/min) and the round corner parts of the prism-shaped ingot block are brought into contact with the grindstone blades 11*gs*, 11*gs* of the cup wheel type rough grinding grindstone, which are doing the aforesaid synchronous control rotation, grinding processing is begun in which grinding fluid is supplied to the work point at a rate of 20-1,000 cc/min on the front and back faces of the workpiece. The leftward movement of the workpiece table is continued, and when the left end of the prism-shaped ingot block that is supported in the clamping mechanism goes beyond the right end position of the pair of cup wheel type grindstones, the round chamfering to a thickness of 2-7 mm is ended. Next comes retraction of the grindstone shafts 11*a*, 11*a* that axially support the pair of cup wheel type rough grinding grindstones 11*g*, 11*g*. Also, the rotation of the workpiece spindle shaft $7a_1$ of the head stock of the clamping device that supports the prism-shaped ingot block that has been given round corner part rough chamfering is stopped (see FIG. 4*c*).

8) The workpiece table 4, on which is mounted the clamping device 7 that supports the prism-shaped ingot block that has been given round corner part rough chamfering, is moved to the left, and in a position where the right end of the prism-shaped ingot block goes beyond the left end of the cup wheel type rough grinding grindstone 11*g* of the rough grinding stage 11, the movement of the workpiece table 4 is stopped.

9) One of the pair of grindstone shafts 11*a* of the rough grinding stage is lowered, the other 11*a* is raised, and they are adjusted to a position so that the grindstone shaft centers 11*o*, 11*o* of the two lie on the same line as the shaft center (C axis) of the prism-shaped ingot block.

10) The pair of grindstone shafts 11*a*, 11*a* of the rough grinding stage 11 are moved forward. When the cup wheel type rough grinding grindstones that are axially supported on these grindstone shafts reaches the margin position of the two sides on the prism-shaped ingot block, the forward movement of the grindstone shafts is stopped. By causing these grindstone shafts 11*a*, 11*a* to rotate, the cup wheel type rough grinding grindstones 11*g*, 11*g* that are axially supported on the grindstone shafts are made to rotate at 1,800-2,600 rpm.

11) The workpiece table 4 on which the clamping mechanism is mounted is moved to the right at a feed speed of 180-220 mm/min. While both sides of the prism-shaped ingot block are brought into contact with the rotating grindstone blades of the cup wheel type rough grinding grindstone 11*g* and the rough grinding is begun, the rightward movement of the workpiece table 4 is continued. When the left end of the prism-shaped ingot block that is supported in the clamping mechanism 7 goes beyond the right end position of the pair of cup wheel type rough grinding grindstones, the rough chamfering ends, and the grindstone shaft 11*a*, which axially supports the pair of couple wheel-type rough grinding grindstone 11*g*, is retracted. If it does not end with one rightward movement of the workpiece table 4, what is done is back-and-forth movement of the workpiece table 4 in the left-right direction at a speed of 180-220 mm/min, as well as infeed grinding by the rough grinding grindstones 11*g*, 11*g*. During both-sides chamfering by these rough grinding grindstones, grinding fluid is supplied at a rate of 50-1,000 cc/min to the processing work point where the prism-shaped ingot block and the cup wheel type rough grinding grindstones 11*g*, 11*g* are in contact (see FIG. 4*d*).

12) The workpiece table 4 on which the clamping mechanism 7 is mounted is moved to the left, and the movement of the workpiece table 4 is stopped at the position where the right end of the prism-shaped ingot block goes beyond the left end of the cup wheel type rough grinding grindstones 11*g*, 11*g* of the rough grinding stage 11.

13) The workpiece spindle $7a_1$ of the head stock 7*a* of the clamping mechanism is rotated 90 degrees. The sides of the silicon block that have not yet been given rough grinding processing are positioned opposite the face of the cup wheel type rough grinding grindstone 11*g*.

14) The pair of grindstone shafts 11*a*, 11*a* are moved forward. When the cup wheel type rough grinding grindstones 11*g*, 11*g* that are axially supported on these grindstone shafts reach the margin position of the two sides of the prism-shaped ingot block, the forward movement of the grindstone shafts 11*a*, 11*a* is stopped.

15) The workpiece table 4, on which the clamping mechanism 7, is mounted is moved to the right at a feed speed of 180-220 mm/min. While rough grinding begins with both sides of the prism-shaped ingot block coming into contact with the grindstone blades 11*gs*, 11*gs* of the cup wheel type rough grinding grindstones 11*g*, 11*g*, which are turning at 1,800-2,600 rpm, the movement of the workpiece table to the right is continued. When the left end of the prism-shaped ingot block, which is supported in the clamping mechanism 7, goes beyond the right end position of the pair of cup wheel type grindstones, the both-sides chamfering comes to an end. The grindstone shafts 11*a*, 11*a* that axially support the pair of cup wheel type rough grinding grindstones 11*g*, 11*g* are retracted and the rotation of the grindstone shafts 11*a*, 11*a* is stopped. If it does not end with one rightward movement of the workpiece table 4, what is done is back-and-forth movement of the workpiece table 4 in the left-right direction at a speed of 180-220 mm/min, as well as infeed grinding by the rough grinding grindstones 11*g*, 11*g*. During both-sides chamfering by these rough grinding grindstones, grinding fluid is supplied at a rate of 50-1,000 cc/min to the processing work point where the prism-shaped ingot block and the cup wheel type rough grinding grindstones 11*g*, 11*g* come into contact (see FIG. 4*e*).

16) One of the pair of grindstone shafts 10*a*, 10*a* of finishing grinding stage 10 is raised, the other is lowered, and the height between the grindstone shaft centers 10*o*, 10*o* of the two is set to 50-220 mm.

17) The pair of grindstone shafts 10*a*, 10*a* on the finishing grinding stage 10 are moved forward. When the distance between the cup wheel type finishing grinding grindstones 10*g*, 10*g* that are axially supported on these grindstone shafts reaches the margin position of the four-corner round corner parts of the prism-shaped ingot block, the advancing movement is stopped, and the grindstone shafts 10*a*, 10*a* are then turned at 2,800-3,200 rpm.

18) By rotating the workpiece spindle shaft 7*a*1 of the head stock of the clamping mechanism, the prism-shaped ingot block is rotated in its shaft-center direction. The workpiece table 4, on which is mounted the clamping mechanism that supports the prism-shaped ingot block that has been given rough grinding processing, is moved to the right at a feed speed of 40-70 mm/min. Grinding processing is begun by bringing the round corner parts of the prism-shaped ingot block into contact with the grindstone blades 10*gs* of the cup wheel type finishing grinding grindstones, which are turning at 2,800-3,200 rpm. The rightward movement of the workpiece table 4 is continued. When the left end of the prism-shaped ingot block, which is supported in the clamping mechanism, goes beyond the right end position of the pair of cup wheel type finishing grindstones 10*g*, 10*g*, the round corner part finishing chamfering is brought to an end, and the grindstone shafts 10*a*, 10*a* that axially support the pair of cup wheel type finishing grinding grindstones are retracted. Also, the rotation of the workpiece spindle shaft $7a_1$ of the head stock of the clamping device that supports the prism-shaped ingot block that has been given round corner part finishing chamfering is stopped. Next, the rotation of the grindstone shafts 10*a*, 10*a* is stopped (see FIG. 4*f*).

19) The workpiece table 4, on which is mounted the clamping device 7 that supports the prism-shaped ingot block that has been given round corner part finishing chamfering, is moved to the left. In a position where the right end of the prism-shaped ingot block goes beyond the left end of the cup wheel type finishing grinding grindstones 10*g*, 10*g* of the finishing grinding stage 10, the movement of the workpiece table 4 is stopped.

20) One of the pair of grindstone shafts 10*a*, 10*a* of the finishing grinding stage 10 is lowered, the other is raised, and they are adjusted to a position so that the grindstone shaft centers of the two lie on the same line as the shaft center of the prism-shaped ingot block.

21) The pair of grindstone shafts 10*a*, 10*a* of the finishing grinding stage 10 are moved forward. When the cup wheel type finishing grinding grindstones 10*g*, 10*g* that are axially supported on these grindstone shafts reaches the margin position of the two sides on the prism-shaped ingot block, the forward movement of the grindstone shafts 10*a*, 10*a* is stopped. By causing these grindstone shafts to rotate at 2,800-3,200 rpm, the cup wheel type finishing grinding grindstones 10*g*, 10*g* that are axially supported on the grindstone shafts are made to rotate.

22) The workpiece table 4, on which the clamping mechanism 7 is mounted, is moved to the right at a feed speed of 210-240 mm/min. While both sides of the prism-shaped ingot block are brought into contact with the rotating grindstone blades 10*gs*, 10*gs* of the cup wheel type rough grinding grindstones, the finishing grinding is begun. The rightward movement of the workpiece table is continued, and when the left end of the prism-shaped ingot block that is supported in the clamping mechanism goes beyond the right end position of the pair of cup wheel type finishing grinding grindstones, finishing chamfering of the two sides {(the front and back surfaces of the ingot block are simultaneously given synchronous control precision finishing grinding processing (an operation in which chamfering to the amount of 0.05-0.1 mm is done)} is done. During this finishing side-chamfering, grinding fluid is supplied at a rate of 50 1,000 cc/min to the processing work point where the prism-shaped ingot block and the cup wheel type finishing grinding grindstones 10*g*,

10*g* are in contact. Upon completion of the processing, the grindstone shafts 10*a*, 10*a* that axially support the pair of cup wheel type finishing grinding grindstones 10*g*, 10*g* are retracted (see FIG. 4*g*).

23) The workpiece table 4, on which the clamping mechanism is mounted, is moved to the left. The movement of the workpiece table 4 is stopped at the position where the right end of the prism-shaped ingot block goes beyond the left end of the cup wheel type finishing grinding grindstones 10*g*, 10*g* of the finishing grinding stage.

24) The workpiece spindle $7a_1$ of the head stock of the clamping mechanism is rotated 90 degrees, and the sides of the silicon block that have not yet been given finishing grinding processing are positioned opposite the face of the cup wheel type finishing grinding grindstones.

25) The pair of grindstone shafts 10*a*, 10*a* are moved forward. When the cup wheel type finishing grinding grindstones 10*g*, 10*g* that are axially supported on these grindstone shafts reach the margin position of the two sides of the prism-shaped ingot block, the forward movement of the grindstone shafts 10*a*, 10*a* is stopped.

26) The workpiece table 4, on which the clamping mechanism 7 is mounted, is moved to the right at a feed speed of 210-240 mm/min. While finishing grinding begins with both sides of the prism-shaped ingot block coming into contact with the grindstone blades 10*gs*, 10*gs* of the cup wheel type finishing grinding grindstones, which are turning at 2,800-3,200 rpm, the movement of the workpiece table 4 to the right is continued. When the left end of the prism-shaped ingot block, which is supported in the clamping mechanism, goes beyond the right end position of the pair of cup wheel type finishing grinding grindstones 10*g*, 10*g*, the both-sides finishing chamfering comes to an end. The grindstone shafts that axially support the pair of cup wheel type finishing grinding grindstones are retracted and the rotation of the grindstone shafts is stopped. During this finishing side-chamfering, grinding fluid is supplied at a rate of 50-1,000 cc/min to the processing work point where the prism-shaped ingot block and the cup wheel type finishing grinding grindstones 10*g*, 10*g* come into contact (see FIG. 4*h*).

27) The workpiece table 4, on which the clamping mechanism is mounted, is moved to the right, and the movement is stopped at the position of the load port 8. At position 8, while the prism-shaped ingot block is rotated by the workpiece spindle $7a_1$ of the head stock, pressurized air is blown onto the surface of the ingot block and air-dries it. When the air drying comes to an end, the operation of rotating the prism-shaped silicon ingot by the head stock 7*a* of the clamping mechanism 7 is ended. Next, the tail stock 7*b* of the clamping mechanism is retracted. The clamping mechanism releases its hold on the prism-shaped ingot block, on which four-corner corner part chamfering and four-side chamfering has been completed. With the workpiece loading/unloading device 13, this prism-shaped ingot block is conveyed out into an empty stocker shelf among the workpiece stockers 14, 14, 14 outside the compound chamfering device 1.

In the above chamfering operation, except for the operation with the side-peeloff stage 90 involving the pair of rotary blades 91*a*, 91*b*, the throughput processing time (throughput) for the chamfering of a prism-shaped monocrystalline silicon ingot block of side 156 mm and height 250 mm leaving round parts on the four corners was 27 minutes, under the conditions of using a pair of cup wheel type rough grinding grindstones of grindstone diameters 230 mm and 260 mm and grinding number 170 and a pair of cup wheel type finishing grinding grindstones of grindstone diameter 260 mm and grinding number 500, a workpiece table 4 feed speed of 60 mm/min during four-corner round corner part chamfering at the rough grinding stage 11 and a workpiece table 4 feed speed of 200 mm/min during both-sides chamfering, the rotation speed of the grindstone shaft 11*a* being 2,400 rpm, a workpiece table 4 feed speed of 60 mm/min during four-corner round corner part chamfering at the finishing grinding stage 10, a workpiece table 4 feed speed of 220 mm/min during both-sides chamfering, and the rotation speed of the grindstone shaft 10*a* being 3,000 rpm. The plane smoothness Ry of the chamfered ingot block was 1.2 μm.

As another implementation of the present invention, one may reverse the processing sequence for the four-corner round grinding and the both-sides grinding of the prism-shaped ingot block in the rough grinding stage 11 and the finishing grinding stage 10.

POSSIBILITIES FOR INDUSTRIAL USE

This is a silicon ingot block compound chamfering device that can reduce the throughput time for the operation of chamfering a silicon ingot block to half that of a conventional processing device. Also, by giving the height between the pair of grindstone shafts of the cup wheel type grindstones during four-corner round grinding processing a separation of 5-20 mm, the useful lifetime of the cup wheel type grindstones has increased to 1.5 to 2 times what it would be when adopting the chamfering method described in the specification of unexamined patent 2010-61844.

EXPLANATIONS OF THE SYMBOLS

1 compound chamfering device
w ingot block
2 machine frame
4 workpiece table
7 clamping mechanism
7*a* head stock
7*b* tail stock
8 load port
10 finishing grinding stage
10*g* cup wheel type finishing grinding grindstone
11 rough grinding stage
11*g* cup wheel type rough grinding grindstone
13 workpiece loading/unloading device
14 workpiece stocker
90 side-peeloff stage
91*a*, 91*b* rotary blades

The invention claimed is:

1. An ingot block compound chamfering device comprising:

a workpiece table provided so as to allow left-right reciprocating movement on guide rails provided in the left-right direction on a machine frame;

a clamping mechanism including a pair of a head stock and a tail stock that are mounted separately on the left and right on the workpiece table;

a drive mechanism that causes left-right reciprocating movement of the workpiece table on which a workpiece is mounted held in the clamping mechanism, the drive mechanism arranged in a direction in which one sees the workpiece table perpendicularly from a front side, and facing from a left-side direction to a right-side direction;

a rough grinding stage on which are provided, in front of and behind the workpiece table, with the workpiece table between them, a pair of cup wheel type grindstones axially supported on a pair of grindstone shafts that can move forward and backward and can be raised and lowered, in such a way that the grindstone planes face each other, the grindstone diameter of the pair of cup wheel type grindstones having a diameter that is greater than the diagonal length of the workpiece, and the diameter of one cup wheel type grindstone is 5-20 mm less than the diameter of the other cup wheel type grindstone;

a finishing grinding stage that is provided parallel to a right horizontal side of the rough grinding stage and in which a pair of cup wheel type grindstones, axially supported on a pair of grindstone shafts that can move forward and backward and can be raised and lowered, are provided in front of and behind the workpiece table with the workpiece table between them, in such a way that the grindstone planes face each other; and a load port that is on a right horizontal side of the finishing grinding stage and an opening through which a workpiece can be moved into and out of the clamping mechanism which includes the pair of the head stock and tail stock mounted separately on the left and right of the workpiece table.

2. A prism-shaped ingot block compound chamfering method using the ingot block compound chamfering device as claimed in claim 1, comprising:

supporting the prism-shaped ingot block on the head stock and tail stock of the clamping mechanism in the load port position; and chamfering four corner R corner parts of the ingot block and four side planes of the ingot block by the cup wheel type grindstones.

3. The method as claimed in claim 2, wherein the chamfering includes a rough chamfering process and a finish chamfering process.

4. The method as claimed in claim 3, wherein the rough chamfering process includes:

moving the workpiece table, on which the clamping mechanism is mounted, to the left, stopping the movement of the workpiece table a position where the right end of the prism-shaped ingot block has gone beyond the left end of the rough grinding stage's cup wheel type rough grinding grindstone, raising one of the pair of grindstone shafts of the rough grinding stage and lowering the other of the pair of grindstone shafts of the rough grinding stage so that the height between the two grindstone shaft centers is set to 50-220 mm, moving the pair of grindstone shafts of the rough grinding stage forward, stopping the forward movement when the distance between the cup wheel type rough grinding grindstones axially supported on the grindstone shafts reaches the margin position of the four-corner round corner parts of the prism-shaped ingot block, rotating the grindstone shafts, rotating the workpiece spindle shaft of the head stock of the clamping mechanism such that the prism-shaped ingot block rotates in its shaft center direction, moving the workpiece table to the right and bringing the round corner parts of the prism-shaped ingot block into contact with the grindstone blades of the rotating cup wheel type rough grinding grindstones to begin the grinding process, continuing the rightward movement of the workpiece table, and ending the rough chamfering of the round corner parts when the left end of the prism-shaped ingot block that is supported in the clamping mechanism goes beyond the right end position of the pair of cup wheel type grindstones, retracting the grindstone shafts that axially support the pair of cup wheel type rough grinding grindstones, and stopping the rotation of the workpiece spindle shaft of the head stock of the clamping device that supports the prism-shaped ingot block whose round corner parts have undergone rough chamfering.

5. The method as claimed in claim 4, wherein the rough chamfering process further includes:

moving the workpiece table, on which is mounted the clamping device that supports the prism-shaped ingot block whose round corner parts have undergone rough chamfering, to the left, stopping the movement of the workpiece table in a position where the right end of the prism-shaped ingot block has gone beyond the left end of the cup wheel type rough grinding grindstones of the rough grinding stage, lowering one of the pair of grindstone shafts of the rough grinding stage, raising the other of the pair of the grindstone shafts of the rough grinding stage, and adjusting the pair of grindstone shafts to a position where the grindstone shaft centers of the two are on the same straight line as the shaft center of the prism-shaped ingot block, moving the pair of grindstone shafts of the rough grinding stage forward, and stopping the forward movement of the grindstone shafts when the cup wheel type rough grinding grindstones axially supported on these grindstone shafts reach the margin position of the two sides of the prism-shaped ingot block, rotating the grindstone shafts and the cup wheel type rough grinding grindstones that are axially supported on the grindstone shafts, moving the workpiece table on which the clamping mechanism is mounted to the right, continuing the rightward movement of the workpiece table while both sides of the prism-shaped ingot block are brought into contact with the grindstone blades of the rotating cup wheel type rough grinding grindstones to begin the rough grinding is begun, ending the rough chamfering of the two sides when the left end of the prism-shaped ingot block that is supported in the clamping mechanism goes beyond the right end position of the pair of cup wheel type rough grinding grindstones, retracting the grindstone shafts that axially support the pair of cup wheel type rough grinding grindstones are retracted, moving the workpiece table on which the clamping mechanism is mounted to the left, and stopping the movement of the workpiece table in a position where the right end of the prism-shaped ingot block goes beyond the left end of the cup wheel type rough grinding grindstones of the rough grinding stage, rotating the workpiece spindle of the head stock of the clamping mechanism 90 degrees, putting the side of the silicon block that has not yet undergone rough grinding in position opposite the plane of the cup wheel type rough grinding grindstones, moving the pair of grindstone shafts forward, stopping the forward movement of the grindstone shafts when the cup wheel type rough grinding grindstones that are axially supported on these grindstone shafts reach the margin position of the two sides of the prism-shaped ingot block, moving the workpiece table on which the clamping mechanism is mounted to the right, continuing the rightward movement of the workpiece table while both sides of the prism-shaped ingot block are brought into contact with the grindstone blades of the rotating cup wheel type rough grinding grindstones to begin the rough grinding ending the rough chamfering of the two sides when the left end of the prism-shaped ingot block that is supported in the clamping mechanism goes beyond the right end position of the pair of cup wheel type grindstones, retracting the grindstone shafts that axially support the pair of cup wheel type rough grinding grindstones, and stopping the rotation of the grindstone shafts.

6. The method as claimed in claim 5, wherein the finish chamfering includes:

raising one of the pair of grindstone shafts of the finishing grinding stage and lowering the other of the pair of grindstone shafts of the finishing grinding stage such that the height between the two grindstone shaft centers is set to 50-120 mm, moving the pair of grindstone shafts of the finishing grinding stage forward, stopping the forward movement when the distance between the cup wheel type finishing grinding grindstones axially supported on the grindstone shafts reaches the margin position of the four-corner round corner parts of the prism-shaped ingot block, rotating the grindstone shafts, rotating the workpiece spindle shaft of the head stock of the clamping mechanism such that the prism-shaped ingot block rotates in its shaft center direction, moving the workpiece table, on which is mounted the clamping mechanism that supports the prism-shaped ingot block that has been roughly ground, to the right such that the round corner parts of the prism-shaped ingot block are brought into contact with the grindstone blades of the rotating cup wheel type finishing grinding grindstones to begin the grinding process, continuing the rightward movement of the workpiece table, and ending the round corner part finishing chamfering when the left end of the prism-shaped ingot block that is supported in the clamping mechanism goes beyond the right end position of the pair of cup wheel type finishing grindstones, retracting the grindstone shafts that axially support the pair of cup wheel type finishing grinding grindstones, stopping the rotation of the workpiece spindle shaft of the head stock of the clamping device that supports the prism-shaped ingot block that has undergone round corner part finishing chamfering, moving the workpiece table on which is mounted the clamping device that supports the prism-shaped ingot block that has undergone round corner part finishing chamfering to the left, stopping the movement of the workpiece table in a position where the right end of the prism-shaped ingot block has gone beyond the left end of the cup wheel type finishing grinding grindstones of the finishing grinding stage, lowering one of the pair of grindstone shafts of the finishing grinding stage and raising the other of the pair of grindstone shafts of the finishing grinding stage such that the grindstone shafts are adjusted to a position where the grindstone shaft centers of the two are on the same straight line as the shaft center of the prism-shaped ingot block, and moving the pair of grindstone shafts of the finishing grinding stage forward, stopping the forward movement of the grindstone shafts when the cup wheel type finishing grinding grindstones axially supported on these grindstone shafts reach the margin position of the two sides of the prism-shaped ingot block, rotating the grindstone shafts to rotate such that the cup wheel type finishing grinding grindstones that are axially supported on the grindstone shafts rotate, moving the workpiece table on which the clamping mechanism is mounted to the right, such that both sides of the prism-shaped ingot block are brought into contact with the grindstone blades of the rotating cup wheel type grindstones and the finishing grinding is begun, continuing the rightward movement of the workpiece table, ending the finishing chamfering of the two sides when the left end of the prism-shaped ingot block that is supported in the clamping mechanism goes beyond the right end position of the pair of cup wheel type finishing grinding grindstones, retracting the grindstone shafts that axially support the pair of cup wheel type finishing grinding grindstones, moving the workpiece table on which the clamping mechanism is mounted to the left, and stopping the movement of the workpiece table in a position where the right end of the prism-shaped ingot block goes beyond the left end of the cup wheel type finishing grinding grindstones of the finishing grinding stage.

7. The method as claimed in claim 6, wherein the finish chamfering process further includes:

rotating the workpiece spindle of the head stock of the clamping mechanism 90 degrees and putting the side of the silicon block that has not yet undergone finishing grinding in position opposite the plane of the cup wheel type finishing grinding grindstones, moving the pair of grindstone shafts forward, stopping the forward movement of the grindstone when the cup wheel type finishing grinding grindstones that are axially supported on these grindstone shafts reach the margin position of the two sides of the prism-shaped ingot block, moving the workpiece table on which the clamping mechanism is mounted to the right, such that while both sides of the prism-shaped ingot block are brought into contact with the grindstone blades of the rotating cup wheel type finishing grinding grindstones and the finishing grinding is begun, continuing the rightward movement of the workpiece table, ending the finishing chamfering of the two sides when the left end of the prism-shaped ingot block that is supported in the clamping mechanism goes beyond the right end position of the pair of cup wheel type finishing grinding grindstones, retracting the grindstone shafts that axially support the pair of cup wheel type finishing grinding grindstones, stopping the rotation of the grindstone shafts, and moving the workpiece table on which the clamping mechanism is mounted to the right.

8. The method as claimed in claim 7, further comprising:

stopping the movement in the load port position, retracting the tail stock of the clamping mechanism, releasing the support of the prism-shaped ingot block on which chamfering of the four corners corner parts and chamfering of the four sides has ended, and transporting the prism-shaped ingot block to the outside of the compound chamfering device.

9. The ingot block compound chamfering device as claimed in claim 1, further comprising:

left-right movement guide rails for the workpiece table that extend to the left end face of the ingot block compound chamfering device;

a side-peeloff stage in which the head stock and tail stock of the clamping mechanism on which the workpiece table is mounted have a workpiece holding shaft between them; and a pair of rotary blades are provided in front of and behind the workpiece table with the workpiece table between them such that rotary blade diameter planes of the rotary blades face each other.

* * * * *